United States Patent [19]

Vining

[11] Patent Number: 4,842,149

[45] Date of Patent: Jun. 27, 1989

[54] PITCHER DISPENSER

[75] Inventor: Curtis G. Vining, Milwaukee, Oreg.

[73] Assignee: Curtis G. Vining, Portland, Oreg.

[21] Appl. No.: 909,904

[22] Filed: Sep. 22, 1986

[51] Int. Cl.[4] ..... A47F 1/00

[52] U.S. Cl. ..... 211/59.2; 312/43

[58] Field of Search ..... 211/59.2, 163; 312/43, 312/45

[56] References Cited

U.S. PATENT DOCUMENTS

| | | | |
|---|---|---|---|
| 1,912,344 | 5/1933 | Chisholm | 312/45 |
| 1,930,321 | 10/1933 | Ogden | 312/45 |
| 2,212,129 | 8/1940 | Rust | 211/59.2 X |
| 2,221,704 | 11/1940 | Farley | 211/59.2 X |
| 2,756,901 | 7/1956 | Cowsert | 211/59.2 X |
| 3,287,073 | 11/1966 | Holtkamp | 211/59.2 X |
| 3,627,394 | 12/1971 | Benn et al. | 312/43 |
| 3,788,487 | 1/1974 | Dawson | 312/43 X |

*Primary Examiner*—Robert W. Gibson, Jr.

[57] ABSTRACT

A rack for holding and dispensing pitchers includes a base on which a cluster of a plurality of vertical tubes is rotatably mounted. The tubes are longitudinally slotted and have enlarged openings at the bottom through which the lowermost pitcher may be removed only when the other pitchers are lifted up in the tube.

3 Claims, 1 Drawing Sheet

PITCHER DISPENSER

The present invention relates to a new and improved rack for facilitating the compact storage and dispensing of pitchers in restaurants and the like.

BACKGROUND OF THE INVENTION

Many pitchers are inherently non-nestable, and being relatively large they have created a storage problem at the location where they are to be used. Beverages are frequently served in public places such as restaurants in pitchers and, therefore, it is necessary to have a relatively large supply of pitchers on hand. If the pitchers are simply placed on a counter, they occupy excessive space. If the pitchers are stacked on one another on the counter there is a danger that they will fall to the floor. Inasmuch as pitchers can be readily contaminated by dust or refuse which might fall therein, it is desirable to store the pitches in an inverted position which presents an added problem because of the fact that pitchers are generally unstable when resting on a counter in the inverted position.

For these and other reasons it is not uncommon in restaurants and the like to store the pitchers on overhead hooks where the ceiling is sufficiently high to permit it, but that method of storage in itself presents other problems related to the difficulty experienced by short people in attempting to reach the pitchers to hang them on the hooks and to remove them from hooks. As a consequence, it would be desirable to provide a compact and attractive rack for holding and protecting a plurality of pitchers at the point of use and from which the pitchers could be easily removed when needed.

SUMMARY OF THE INVENTION

Briefly, there is provided in accordance with the teachings of the present invention a storage rack which includes one or more rigid vertical tubes which are each open at the top and bottom ends to hold a plurality of pitchers, one above the other, and which are slotted from top to bottom to receive the handles of the pitchers and thus orient them within the tubes. A stop shoulder is provided on a ledge located in proximity to the bottom of each tube and on which the pouring spout of the lowermost pitcher rests to prevent that pitcher and the other pitchers disposed in the tube above it from falling out of the bottom of the tube.

Pitchers are preferably stored in the tubes in an inverted position, and the portion of the tube which is diametrically opposite to the stop shoulder is cut away so that the slot is flared outwardly toward the bottom to have an angular extent of approximately one hundred eighty degrees or more. This permits the lowermost pitcher when lifted off of the shoulder to be cocked in an upward direction toward the slot for removal of the pitcher through the flared out portion of the slot. The flared out portion of the slot is substantially shorter in length than is the corresponding height of the pitcher to prevent inadverent removal of the bottom pitcher and the subsequent dropping of the next pitcher onto the shoulder.

In order to remove a pitcher from the rack the user grasps the handle of the lowermost rack lifts it and any other pitchers in the same tube a short distance and then cocks the lowermost pitcher in an upward direction toward the slot to move the spout of the pitcher past the ledge. As the pitcher is then removed through the flared out portion it is slowly lowered until the pouring spout on the next pitcher rests on the shoulder.

Fresh pitchers are easily loaded into the top of the tube, but if desired because, for example, of overhead space limitations, the pitchers can be loaded into the tubes from the bottom.

In a preferred embodiment of the invention three or more tubes are symmetrically mounted in a cluster to a central post for rotation about the axis of the post, the post extending up from a support base which may rest on a counter in proximity to the point of use of the pitchers.

GENERAL DESCRIPTION OF THE DRAWING

The present invention will be better understood by a reading of the following detail description taken in connection with the accompanying drawing wherein.

DETAILED DESCRIPTION OF A PREFERRED EMBODIMENT

Figure 1:
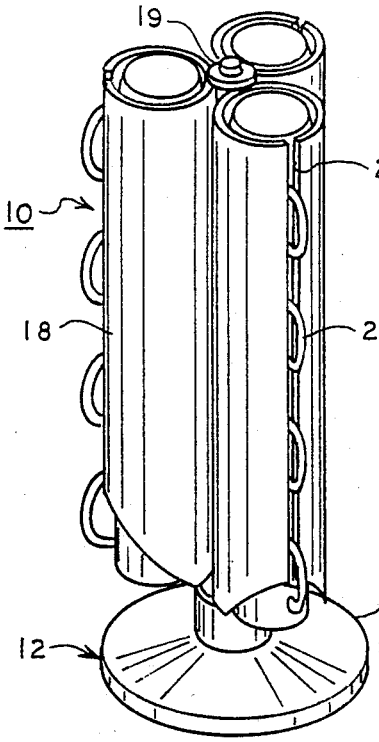
FIG. 1 is a perspective view of a rack for holding and dispensing pitchers.

Referring to the drawing, there is a shown a rack 10 which comprises as its principal elements a base 12 including a circular portion 14 having a flat bottom surface adapted to rest on a countertop or the like and a central hub 16 in which the lower end of a post 17 is rotatably supported. A plurality of cylindrical tubes 18 are fixedly mounted in a cluster to post 17. The post 17 is rotatable relative to the base 12 whereby the cluster of tubes 18 may be rotated about the central vertical axis of the post. A cap member 19 is fitted onto the top of the post 17.

Figure 3:
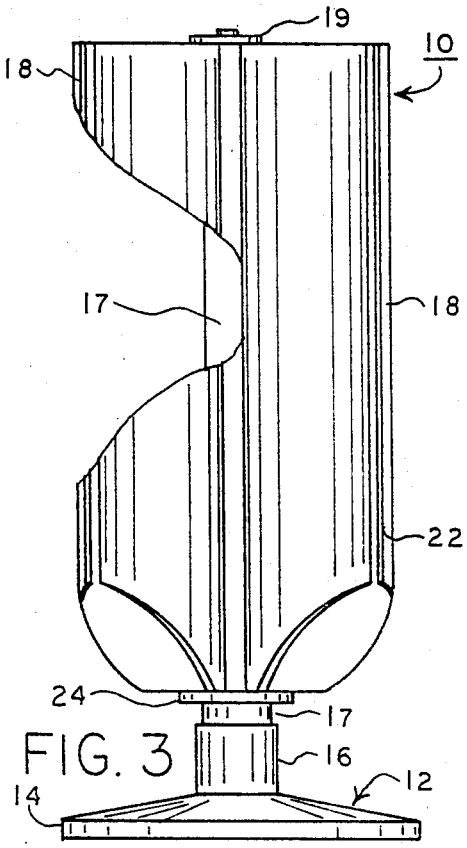
FIG. 3 is an elevational view, partly broken away, of the rack shown in FIGS. 1 and 2.
Figure 4:
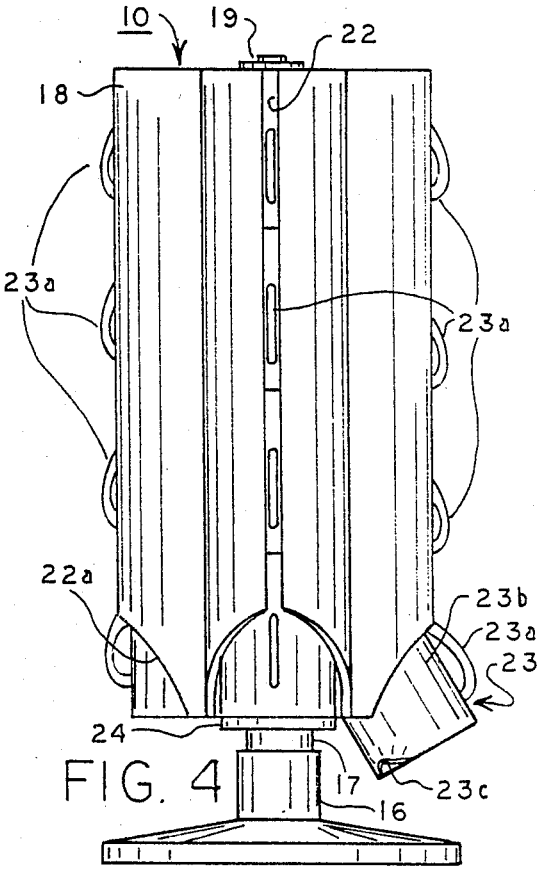
FIG. 4 is a elevational view of the rack shown in FIGS. 1 and 3, one pitcher being shown during removal thereof from the rack.

Each of the pitcher storage tubes 18 is open at the top and bottom and is provided with a vertical slot 22 which extends from the top to the bottom of its associated tube. As may best be seen in FIGS. 1 and 4, the lower portion of each slot 22 is flared outwardly at **22*a* to an angular extent which at the bottom is about 180 degrees. The flared out portion 22*a* is curved as shown in FIG. 3. The vertical extent of the flared portion 22*a* is substantially less than the height of the pitchers 23 with which the rack 10 is adapted to be used and as more fully described hereinafter is sufficiently large in cross sectional size to permit removal of a pitcher from the rack through the opening defined by the flared out portion 22*a*** of slot.

Figure 2:
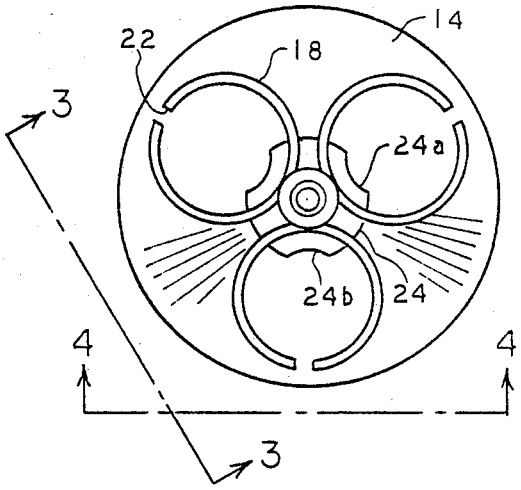
FIG. 2 is a plan view of rack shown in FIG. 1.

An annular stop member 24 is mounted on the post 17 at the bottom end of the tubes 18 and provides an upwardly facing shoulder **24*a* on which the tubes 18 rest. For the reasons explained hereinafter, the stop member 24 is provided with three arcuate notches 24*b* respectively disposed on the diameters of the tubes 18. As best shown in FIG. 2, the annular member 24 has a sufficient external diameter interiorly of the notches 24*b* so as to extent into the space directly below the interiors of the tubes 18 and to provide a ledge which engages the pouring spouts of the lowermost ones of the pitchers located within the tubes 18**.

As shown in FIGS. 1 and 3, a plurality of pitchers 30 are adapted to be stored in inverted positions in each of the tubes 18 with the pouring spout portion of the lowermost pitcher resting on the ledge 24 as best shown on the left side of FIG. 3. The upper portion of the slot 22 is of uniform width and slightly greater than the corresponding thickness of the handle portion 23*a* of the pitchers 23. The diameter of the tubes 18 is slightly greater than the diameter of the body portion 23*b* and the laterally extending spout portion 23*c* which is opposite to the handle portion 23*a*.

When in the stored position as shown in FIG. 1, the pouring spouts of the lowermost pitchers rest on the ledge 24 and prevent removal of the pitchers from the tubes. When it is desired to remove a pitcher, the handle 23*a* of a bottom pitcher is grasped and that pitcher is lifted a sufficient distance to permit cocking of the pitcher in an upward direction towards the slot 22 to clear the spout 23*c* of the ledge 24 so that the pitcher can then be removed from the tube through the flared out lower portion 22*a* while lowering the spout 23*c* through the notch 24*b*. As the lowermost pitcher is removed the pitchers above it are slowly lowered until the bottom pitcher rests on the ledge 24.

In order to facilitate removal of the pitchers from the tubes, the ledge 24 is provided with arcuate notches 24*a*. It will be understood that the internal diameter of the tubes 18 must be sufficiently larger than the external diameter of the body portion of the pitcher 23 to permit tilting of the pitcher in the associated tube to the position shown in FIG. 3 for removal of the pitcher. It will be understood that where desired the user can use one hand to lift and tilt the lowermost pitcher and use his other hand to grasp the handle of the next to lowest pitcher and lift that pitcher and those above it away from the lowermost pitcher so as to facilitate cocking of the lowermost pitcher to clear the spout of the ledge and therefor to permit its removal through the flared out portion 22*a*.

If desired, the individual tubes 18 may be mounted separately to a wall or other supporting device if counter space is not available for the entire rack.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A rack for holding a plurality of pitchers of the type having a general cylindrical body with a pouring spout extending laterally therefrom and a handle extending laterally from the side of said body opposite said pouring spout the combination comprising a vertically disposed rigid tube having an open top end and an open bottom end, said tube having an internal cross-sectional size which is greater than the maximum cross-sectional size of said body and said spout, said tube having a vertical slot extending from said top and to said bottom end, the width of said slot exceeding the maximum thickness of said handle to permit said handle to move freely up and down said slot as the associated one of said pitches is moved up and down in said tube and being less than the diameter of said body portion of said pitcher, and ledge means in proximity to said bottom end of said tube providing a shoulder located opposite to said slot for engaging only an arcuate portion of said bottom of said tube for engaging the spout of a pitcher disposed in said tube to retain said pitcher in said tube, the bottom portion of said slot being flared outward to an angular distance of about 180 degrees;

said flared portion of said slot having a vertical length substantially less than the height of each of said pitchers, and said tube being internally dimensioned to permit the lowermost pitcher to be cocked a sufficient amount within said tube so as to be removed from said tube through said flared out portion of said slot when said lowermost pitcher is lifted in said tube off of said ledge.

2. A rack according to claim 1 wherein said tube is cylindrical.

3. A rack for holding a plurality of pitchers, comprising in combination a base, a post extending upwardly from said base, a plurality of rigid, cylindrical tubes respectively mounted to said post along a longitudinal element thereof, said tubes being open at the top and bottom ends thereof and being respectively provided with a vertical slot diametrically opposite to said longitudinal element and extending from the top to the bottom of the respective tube, an annular stop member connected to said post and disposed immediately below said tubes, said stop member extending a substantial distance into the spaces directly below the interiors of said tubes, said slots being flared outwardly at the bottom portions of said tubes to an angular extent of about 180 degrees or more, and wherein said stop member is provided with notches respectively centered on the diameters of said tubes.

* * * * *